US006966301B2

(12) United States Patent
Knight et al.

(10) Patent No.: US 6,966,301 B2
(45) Date of Patent: Nov. 22, 2005

(54) ACCUMULATOR FUEL SYSTEM

(75) Inventors: Andrew Knight, Stroud (GB); Andrew Male, Walton on Thames (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/701,142

(22) Filed: Nov. 4, 2003

(65) Prior Publication Data

US 2004/0118381 A1 Jun. 24, 2004

Related U.S. Application Data

(63) Continuation-in-part of application No. 10/427,251, filed on May 1, 2003, now Pat. No. 6,843,053, and a continuation-in-part of application No. 10/427,229, filed on May 1, 2003.

(30) Foreign Application Priority Data

| | | |
|---|---|---|
| May 3, 2002 | (GB) | 0210305 |
| Jul. 4, 2002 | (GB) | 0215487 |
| Oct. 31, 2002 | (GB) | 0225392 |
| Feb. 17, 2003 | (EP) | 03250957 |
| Apr. 7, 2003 | (EP) | 03252188 |

(51) Int. Cl.[7] ..... F02M 55/02; F01L 1/18
(52) U.S. Cl. ..... 123/456; 123/468; 123/508
(58) Field of Search ..... 123/456, 447, 123/468, 507, 508, 90.36, 469

(56) References Cited

U.S. PATENT DOCUMENTS

| | | | | |
|---|---|---|---|---|
| 3,859,973 | A * | 1/1975 | Dreisin | 123/502 |
| 5,553,592 | A | 9/1996 | Bauerle et al. | |
| 5,758,620 | A * | 6/1998 | Warner | 123/321 |
| 6,026,786 | A * | 2/2000 | Groff et al. | 123/501 |
| 6,439,202 | B1 | 8/2002 | Carroll, III et al. | |

FOREIGN PATENT DOCUMENTS

| | | |
|---|---|---|
| DE | 3826144 A1 | 2/1990 |
| DE | 19544241 A1 | 6/1996 |
| DE | 10000384 A1 | 7/2001 |
| DE | 10108572 A1 | 9/2001 |
| EP | 0704619 A1 | 7/1995 |

* cited by examiner

*Primary Examiner*—Weilun Lo
(74) *Attorney, Agent, or Firm*—David P. Wood

(57) ABSTRACT

An accumulator fuel system for an internal combustion engine having a plurality of engine cylinders, includes an accumulator fuel volume for supplying high pressure fuel to one or more of a plurality of injectors, each of which is arranged to supply fuel to an associated one of the engine cylinders. The accumulator fuel volume is integrated within an engine component, where the engine component provides a purpose other than that solely of an accumulator volume for storing high pressure fuel. The accumulator fuel volume is therefore defined in an existing engine component, to reduce part count, weight and cost. In one embodiment the accumulator fuel volume is defined within a rocker shaft of the engine and in another embodiment within the engine cylinder head.

6 Claims, 3 Drawing Sheets

ACCUMULATOR FUEL SYSTEM

FIELD OF THE INVENTION

The present invention relates to an accumulator fuel system use in an internal combustion engine, and in particular to an accumulator fuel system in the form of a common rail fuel system.

BACKGROUND OF THE INVENTION

Accumulator-type fuel systems have an accumulator fuel volume for receiving fuel at high pressure and for delivering high pressure fuel to at least one of the injectors of the engine. Such systems are often referred to as common rail fuel systems and provide advantages for compression ignition internal combustion engines due to their flexibility and adaptability to engines of different type. Additionally, the pump requirement of the engine may be satisfied using just one high pressure fuel pump for supplying the common rail fuel volume, as opposed to an individual pump being required for each injector. The drive torque for common rail systems is also relatively low due to the ability to store energy within the rail fuel volume.

It is a disadvantage of common rail fuel systems that the common rail housing defining the rail volume occupies a large accommodation space within the engine. The rail housing is typically a forged part formed from steel and often must have relatively thick walls to withstand the high fuel pressures inside. The rail housing is therefore a relatively heavy and costly feature of the engine.

It is an object of the present invention to provide an accumulator fuel system which addresses the aforementioned problems.

SUMMARY OF THE INVENTION AND ADVANTAGES

According to a first aspect of the invention, there is provided an accumulator fuel system for use in an internal combustion engine having a plurality of engine cylinders, the fuel system including an accumulator fuel volume for supplying high pressure fuel to one or more of a plurality of injectors, each of which is arranged to deliver fuel to an associated one of the engine cylinders, wherein the accumulator fuel volume is integrated within an engine component which provides a purpose other than that solely of an accumulator fuel volume.

In one preferred embodiment, the fuel system includes a rocker shaft upon which a rocker member is pivotally mounted, wherein the rocker member is arranged to control one or more inlet and/or exhaust valves of an associated engine cylinder and wherein the accumulator volume is integrated within the rocker shaft.

In other words, the accumulator fuel volume (common rail fuel volume) forms an integral part of the rocker shaft as it is defined by an internal volume of the shaft. The rocker shaft therefore provides two functions; a shaft for supporting pivotal movement of a rocker arm and an accumulator fuel volume.

It is thus an advantage of the invention that an existing engine component (e.g. the rocker shaft) defines the common rail fuel volume for high pressure fuel, thereby avoiding the need for a separate large and heavy forged common rail housing.

It is a further advantage of defining the common rail fuel volume within the rocker shaft that the rocker shaft can be mounted conveniently and securely to the engine cylinder head and, thus, vibration of the common rail fuel volume, which is defined with it, is minimised.

The accumulator fuel system may be of the hybrid unit injector-common rail type, in which a high pressure fuel pump supplies fuel to the accumulator volume within the rocker shaft at a first pressure level, and wherein each injector includes an additional pumping plunger for pressurising fuel, supplied from the accumulator fuel volume to the injector, to a second pressure level higher than the first pressure level. Such systems provide the advantage that injection can be achieved at one of two levels, thereby providing benefits for the injection characteristic.

Alternatively the accumulator fuel system may be of the type in which a high pressure fuel pump supplies fuel to the accumulator fuel volume within the rocker shaft and delivers fuel to the injectors directly for injection of fuel at rail pressure. In this case each injector may include a piezoelectric or electromagnetic nozzle control valve for controlling injection, but does not have its own dedicated pumping plunger.

In a particularly embodiment, the rocker shaft is provided with a first rocker member for controlling one or more engine cylinder inlet valves, a second rocker member for controlling one or more engine cylinder exhaust valves and a third rocker member for transmitting drive to the pumping plunger of an associated injector.

The rocker shaft may have a longitudinal axis which is arranged to extend substantially perpendicular to a longitudinal axis of a pumping plunger of one or more of the injectors.

In another embodiment the cylinder head itself defines the accumulator fuel volume. The cylinder head is a conventional part of existing engine installations mounted above the combustion chambers and upon which other fuel system components, such as the injectors and the inlet and exhaust valve components, are mounted.

The aforementioned features of the invention may also be provided with an engine cylinder head rail volume.

According to a second aspect of the invention, there is provided an accumulator for use in an accumulator fuel system, wherein the accumulator includes a rocker shaft or an engine cylinder head having an internal volume which defines the accumulator fuel volume.

According to a second aspect of the present invention, an accumulator fuel system for an internal combustion engine having a plurality of engine cylinders forming combustion chambers and one or more inlet and/or exhaust valves associated with the engine cylinders, is provided. The internal combustion engine further includes a plurality of components for delivering fuel to the combustion chambers and controlling combustion therein. The fuel system comprises an accumulator fuel volume for supplying high pressure fuel to at least one injector. The at least one injector is arranged to supply fuel to one of the combustion chambers. The accumulator fuel volume is formed in one of the plurality of components of the internal combustion engine.

It will be appreciated, therefore, that the invention is intended to relate to the accumulator component of the fuel system itself, as well as to a fuel system incorporating an accumulator volume and other fuel system parts.

BRIEF DESCRIPTION OF THE DRAWINGS

Other advantages of the present invention will be readily appreciated as the same becomes better understood by reference to the following detailed description when considered in connection with the accompanying drawings wherein.

The invention will now be described, by way of example only, with reference to the accompanying drawings in which.

DETAILED DESCRIPTION OF THE PREFERRED EMBODIMENT

The accumulator fuel system of the present invention is intended for use as a common rail system in which a common source of high pressure fuel is arranged to supply fuel to a plurality of injectors of the system. The fuel system may be referred to as a "hybrid unit injector-common rail fuel system" and is described in detail in our co-pending European patent application, EP 03252188.2. Such systems have the flexibility to allow fuel injection into the engine cylinder either at rail pressure or at an increased pressure level and therefore provide advantages for the fuel injection characteristic.

Figure 1:
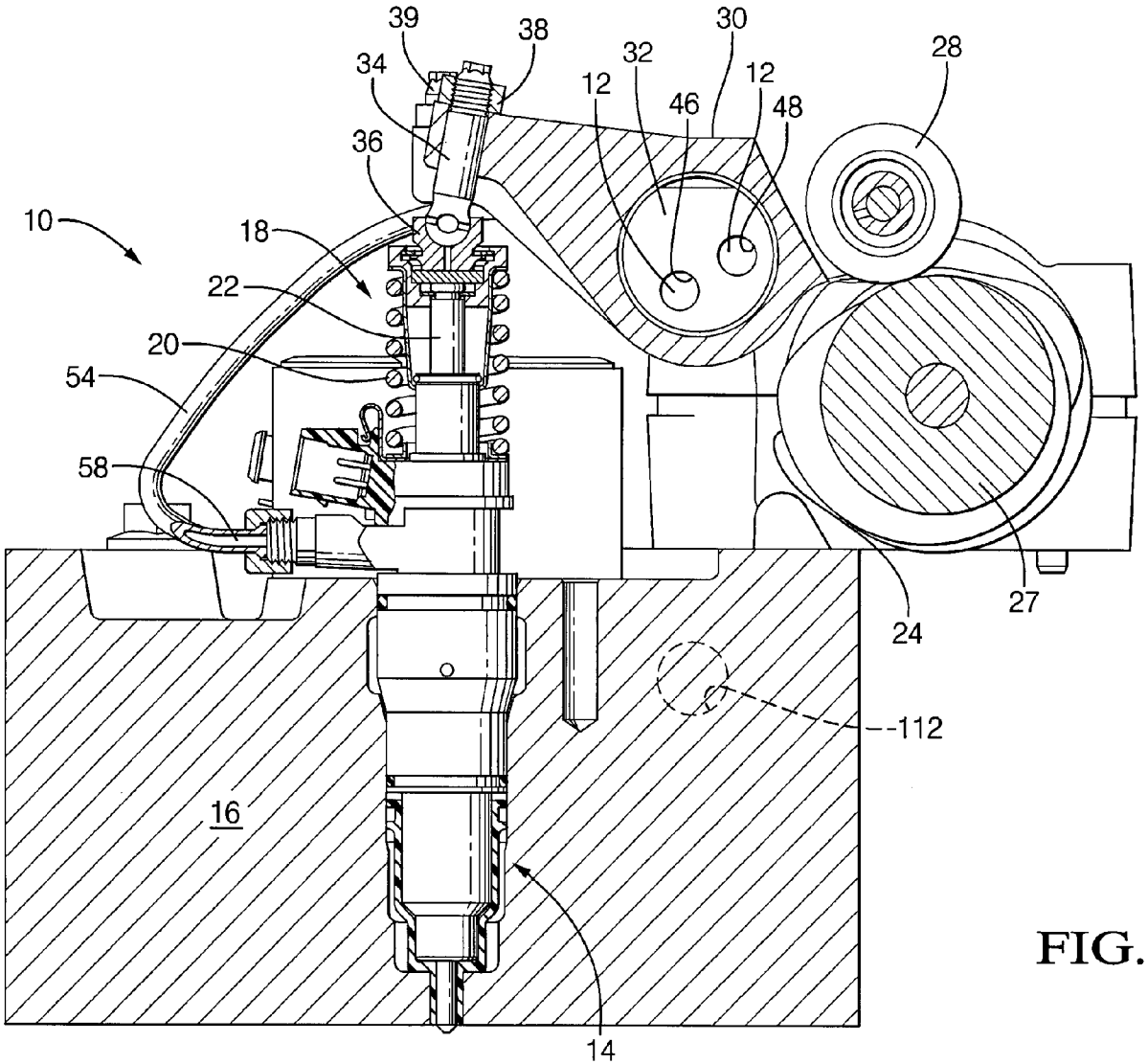
FIG. 1 is a sectional view of one embodiment of the accumulator fuel system of the present invention, in the form of a common rail fuel volume defined within an engine rocker shaft.

Referring to FIG. 1, the fuel system includes a plurality of injectors (only one of which is shown—10) for receiving high pressure fuel from an accumulator or rail volume 12, often referred to as a "common rail". The rail volume 12 is charged with fuel at a first injectable pressure level, referred to as rail pressure, by means of a separate high pressure fuel pump (not shown) and supplies fuel at rail pressure to all injectors of the system. Important features of the rail volume 12 will be described in further detail later.

Each injector 10 includes an injection nozzle, referred to generally as 14, and a dedicated pumping element 18. The injection nozzle 14 is mounted within a cylinder head 16 of the associated engine. The pumping element 18 includes a plunger 20 that is driven, in use, to pressurise fuel within a pump chamber (not shown) of the injector. Such injectors 10 are sometimes referred to as unit injectors and include dedicated electronic spill and nozzle control valves for controlling fuel pressurisation and injection. The injector and pump element components of a unit injector are arranged in a single unit.

Internal parts of the injection nozzle are not shown in FIG. 1, but it will be appreciated by those familiar with diesel fuel engine technology that it is by controlling movement of an injection nozzle valve needle between open and closed states that injection of fuel into the associated engine cylinder is controlled.

The plunger 20 of each pumping element 18 has an associated return spring 22, which biases the respective plunger 20 in an upward direction (in the illustration shown) along its longitudinal axis in an outward direction from its pump chamber. The plunger 20 is driven to move against the spring force (in a downward direction along its axis) by means of a cam drive arrangement so as to reduce the volume of the pump chamber. The plunger 20 therefore performs a pumping cycle including a forward stroke under the drive force of the cam drive, between maximum and minimum pump chamber volume, and a return stroke under the return spring force, between minimum and maximum pump chamber volume. In circumstances in which the injector spill valve is closed during the plunger forward stroke, movement of the plunger 20 to reduce the volume of the pump chamber causes fuel within the pump chamber to be pressurised to a higher level.

The injector incorporates a rail control valve (not shown) so that fuel at rail pressure is either (i) delivered to the injection nozzle 14 for injection at rail pressure or (ii) further pressurised within the pump chamber due to plunger motion to a second, higher pressure level due to motion of the plunger 20. This is a particular function of a hybrid unit injector-common rail fuel system, which permits injection of fuel at two different pressure levels.

The cam drive arrangement associated with each injector includes a cam member 24 which is driven by means of an engine driven shaft 27. A roller 28 co-operates with the surface of the cam 24 as it is driven, in use, and in turn the roller 28 drives pivotal movement of a rocker member 30, or rocker arm. The rocker arm 30 is pivotally mounted upon a rocker shaft 32 which has a longitudinal axis having a plane extending in a direction substantially perpendicular to a plane of the longitudinal axis of the plunger 20. The rocker arm 30 is provided an adjuster member 34, the base end which is of generally part-circular form and received within a correspondingly shaped recess or socket in an intermediate drive member 36. The intermediate drive member 36 is coupled to the plunger 20 through a retaining foot 37.

The adjuster 34 is in screw threaded engagement with the rocker arm 30 and provides a means for adjusting the positions of the plunger 20 at minimum and maximum pump chamber volume, relative to the angular position of the cam 24. A locking nut 38 is provided to retain the adjuster 34 and the rocker arm 30 in secure fixed connection with one another when the adjuster 34 has been adjusted correctly.

In use, as the cam 24 is driven upon rotation of the engine driven shaft 27, the rocker arm 30 is caused to pivot about the rocker shaft 32, thereby imparting drive to the plunger 20 through the parts 34, 36, and 37. The function of the rocker arm 30 is thus to provide a transmission means through which drive is imparted to the plunger 20 by the driven cam 24.

Figure 4:
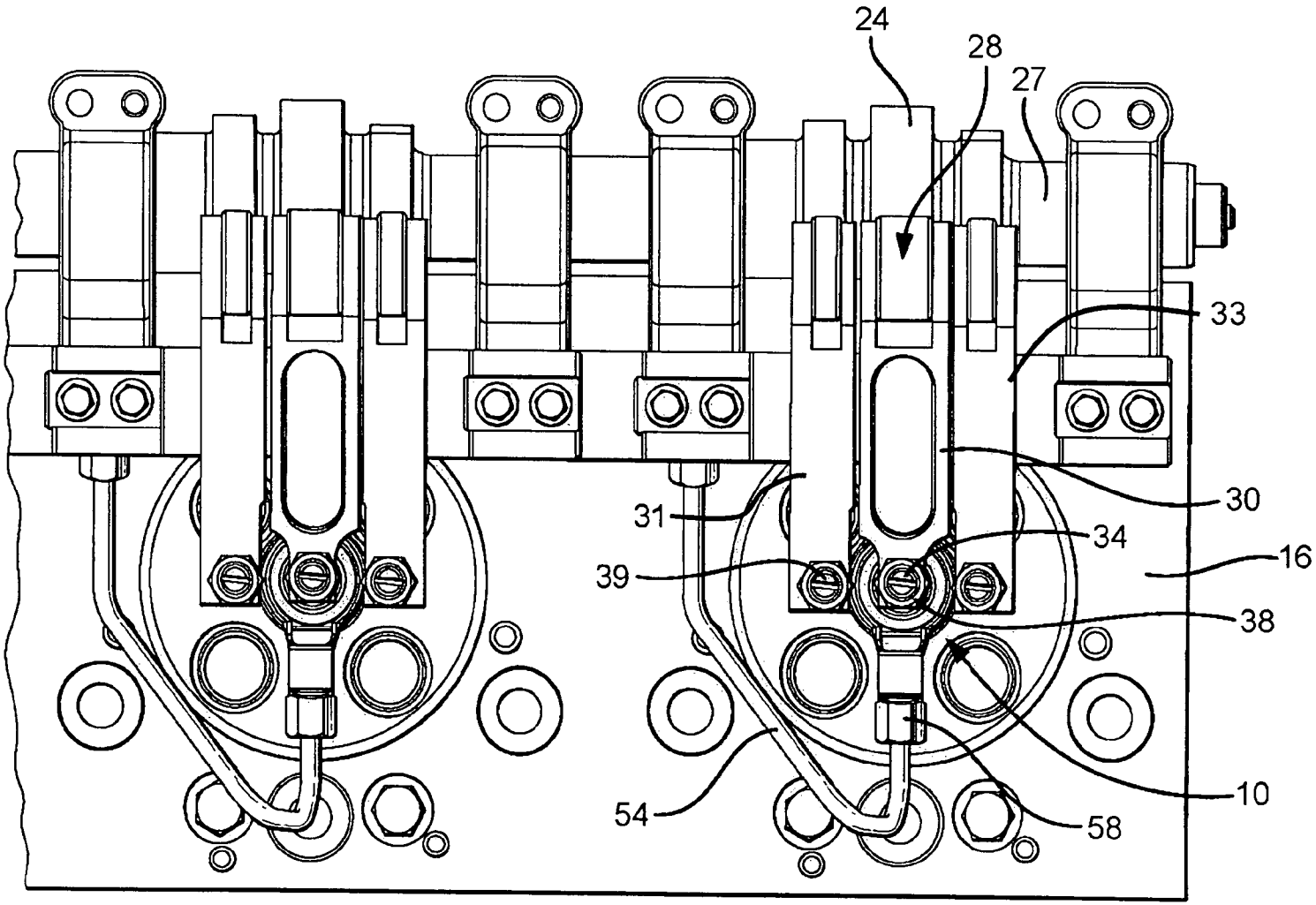
FIG. 4 is a plan view of the embodiment of the accumulator fuel system of the present invention as shown in FIG. 1.

In addition to a rocker arm 30 being provided for each injector pumping element 18, the rocker shaft 32 may also carry at least two further rocker arms. A second one of the rocker arms 31 (see FIG. 4), but an adjuster 39 of which is just visible in FIG. 1, is operable to control the operation of one or more inlet valves of the associated injector engine cylinder. A third one of the rocker arms 33 is operable to control the operation of one or more exhaust valves of the associated injector engine cylinder. Each of the second and third rocker arms 31, 33 has an associated cam arrangement, similar to parts 24, 27. The manner in which the second and third rocker arms 31, 32 control operation of the inlet and exhaust valves of the engine cylinder is well known and would be familiar to a person skilled in diesel engine technology, and so will not be described in further detail here.

Figure 2:
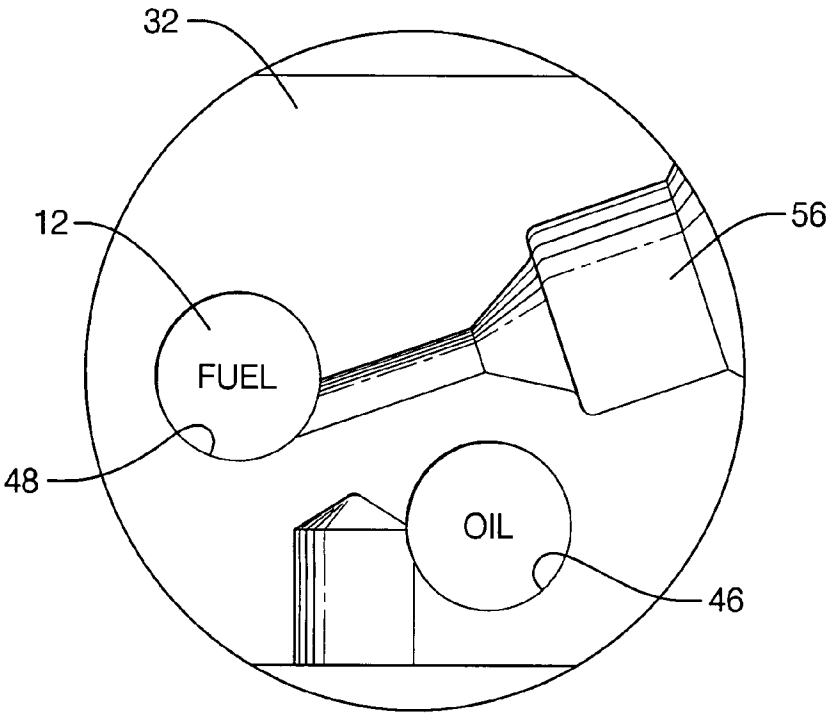

As can be seen in more detail in FIG. 2, the rocker shaft 32 is provided with first and second axially extending passages, 46, 48 respectively, formed by drillings through the shaft 32. The first passage 46 defines an oil flow passage for lubricating oil for the three rocker arms 30. It is a particular feature of the invention that the second passage 48 defines the common rail fuel volume 12, so that the rail volume forms an internal volume within the rocker shaft 32.

The rail volume 12 may be provided, preferably at one end, with a rail pressure sensor (not shown). The rail pressure sensor provides an output signal indicative of fuel pressure within the rail volume 12 and rail pressure may be controlled in response to this signal to ensure it is maintained at a substantially constant value.

The rail passage 48 extending through the rocker shaft 32 is arranged to deliver fuel to each of the injectors 10 through a fuel supply passage 54. The fuel supply passage 54 has a rail-end connector 56 (visible in FIG. 2 only) and an injector-end connector 58 (visible in FIG. 1 only).

Figure 3:
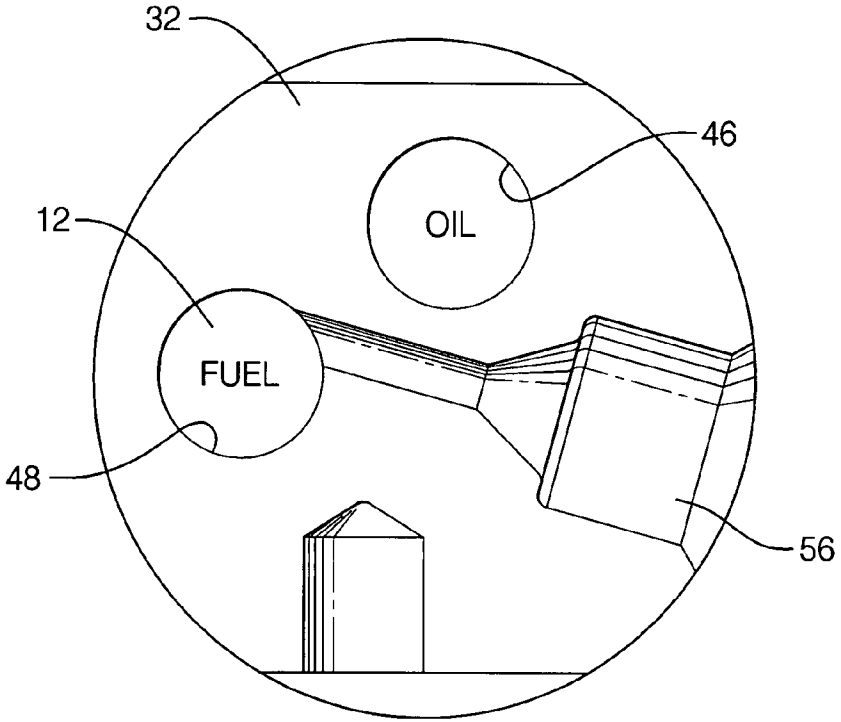
FIGS. 2 and 3 are sectional views to show two alternative locations for the common rail fuel volume within the rocker shaft of the fuel system in FIG. 1

FIG. 3 shows alternative locations for the rail passage 48 and the oil passage 46 within the shaft 32. Although it is known to provide the oil passage 48 through the rocker shaft 32 in existing fuel systems, due to the requirement for the additional passage 48 to be provided through the rocker shaft 32 to define the rail volume 12, the oil passage 46 must be of smaller diameter and displaced off-centre from the shaft axis to ensure there is sufficient space available for the passage 48.

The rocker shaft 32 may also be provided with various oil drillings (not shown) in a conventional manner, which permit lubricating oil to be supplied to rocker arm bearings and the pumping element 18 of the unit injector 10 from the passage 46.

As it is necessary to provide the rocker shaft 32 in the engine for a purpose other than defining the rail volume 12, it is a particular advantage of the present invention that there is no requirement for an additional common rail component within the fuel system as an existing part of the engine is utilised for this purpose. By defining the rail volume 12 within the existing rocker shaft component of the engine a considerable advantage is obtained in terms of accommodation space. The common rail component of a fuel system is also a particularly heavy component and so the elimination of this housing part altogether from the engine, by defining the rail volume within an already existing component, provides a significant weight and cost advantage also.

The invention is particularly applicable to hybrid unit injector-common rail fuel systems, as described previously, where the pressure demands for the rail volume are reduced due to the ability of the unit injectors 10 to increase rail pressure to higher injection pressures by virtue of their dedicated pumping elements 18 and rail control valves. The rail volume 12 can therefore be defined within a component having relatively thin walls, such as the rocker shaft 32.

The invention is equally applicable, however, to systems where the rail volume 12 supplies fuel to the injectors but in which there is no additional pumping element 18 in the injectors to increase fuel pressure above rail pressure. The invention therefore applies equally to more conventional common rail fuel systems in which rocker arms are provided on a rocker shaft 32 for controlling operation of the inlet and/or exhaust valves of the engine cylinders only, but in which no third rocker arm (e.g. rocker arm 30) is required.

The invention is also applicable if the injectors take the form of unit pumps, which have a dedicated pumping element for increasing fuel pressure above rail pressure, but where the associated injector for each pumping element is spaced remotely from its pumping element, the pump and injector components being connected by a high pressure fuel line.

In another embodiment of the invention, the rocker shaft 32 may be provided with a plurality of accumulator volumes, each of which is defined by a separate passage and/or internal volume within the shaft 32 and is arranged to supply fuel to a different one or more of the injectors of the associated fuel system.

In yet another embodiment of the invention, and as indicated by the dashed feature identified by 112 in FIG. 1, instead of defining the rail volume 12 within the rocker shaft 32, the rail volume 112 may be defined within the engine cylinder head 16. Again, as the rail volume 112 is integrally formed within an already existing part of the engine, there is no need to provide a separate rail volume component and, hence, the aforementioned weight and cost advantages are obtained. The fuel system of this embodiment may be provided with any of the aforementioned types of injector or unit pump.

Obviously, many modifications and variations of the present invention are possible in light of the above teachings. The invention may be practiced otherwise than as specifically described within the scope of the appended claims.

What is claimed is:

1. An accumulator fuel system for an internal combustion engine having a plurality of engine cylinders, the fuel system including:

a plurality of injectors, each of which is arranged to deliver fuel to an associated one of the engine cylinders;

a rocker shaft upon which a plurality of rocker members are pivotally mounted, wherein one rocker member is arranged to control one or more inlet and/or exhaust valves of an associated engine cylinder;

an accumulator fuel volume integrated within the rocker shaft for supplying high pressure fuel to the plurality of injectors;

wherein the accumulator fuel volume is arranged to supply fuel at a first pressure level to the plurality of injectors and wherein each injector is associated with a pumping element for pressurising fuel to a second pressure level which is higher than the first pressure level said pumping element driven by another rocker member.

2. The accumulator fuel system as claimed in claim 1, wherein the rocker shaft is provided with a first axially extending passage for receiving a lubricating fluid and a second axially extending passage defining the accumulator fuel volume.

3. The accumulator fuel system as claimed in claim 1, including a first rocker member for controlling one or more engine cylinder inlet valves, a second rocker member for controlling one or more engine cylinder exhaust valves and a third rocker member for transmitting drive to said pumping element of an associated injector, wherein the first, second and third rocker members are pivotally mounted upon the rocker shaft.

4. The accumulator fuel system as claimed in claim 1, wherein the rocker shaft has a longitudinal axis which is arranged in a plane that extends substantially perpendicular to a plane of a longitudinal axis of the pumping element of an associated injector.

5. An accumulator fuel system for an internal combustion engine having a plurality of engine cylinders forming combustion chambers, one or more inlet and/or exhaust valves associated with the engine cylinders and a rocker shaft having a rocker member pivotally mounted thereon and being arranged to control the one or more inlet and/or exhaust valves, the internal combustion engine further including an accumulator fuel volume for supplying high pressure fuel to at least one injector, wherein the accumulator fuel volume is formed within the rocker shaft and wherein the accumulator fuel volume is arranged to supply fuel at a first pressure level to the at least one injector, each of the at least one injectors including an additional pumping element for pressurising fuel to a second pressure level higher than the first pressure level, each of the additional pumping elements being driven by a respective rocker member pivotally mounted on the rocker shaft.

6. An accumulator fuel system for an internal combustion engine having a plurality of engine cylinders forming combustion chambers and one or more inlet and/or exhaust valves associated with the engine cylinders, and a rocker shaft having a rocker member pivotally mounted thereon and being arranged to control the one or more inlet and/or exhaust valves, the internal combustion engine further including an accumulator fuel volume for supplying high pressure fuel to at least one injector, the at least one injector being arranged to supply fuel to one of the combustion chambers, wherein the accumulator fuel volume is arranged to supply fuel at a first pressure level to the at least one injector, each of the at least one injectors including an additional pumping element for pressurising fuel to a second pressure level higher than the first pressure level, each of the additional pumping elements being driven by a respective rocker member pivotally mounted on the rocker shaft, the improvement comprising that the accumulator fuel volume is formed in the rocker shaft.

* * * * *